United States Patent [19]

Morrice

[11] Patent Number: 4,487,530

[45] Date of Patent: Dec. 11, 1984

[54] METHOD OF AND APPARATUS FOR SHORING A TRENCH

[76] Inventor: Anthony R. S. Morrice, 1 March Ave., Waterside, Knaresborough, N. Yorkshire, England

[21] Appl. No.: 419,388

[22] Filed: Sep. 17, 1982

[30] Foreign Application Priority Data

Sep. 18, 1981 [GB] United Kingdom ..... 8128245

[51] Int. Cl.[3] ..... E02D 17/00

[52] U.S. Cl. ..... 405/282; 405/272

[58] Field of Search ..... 405/272, 282, 283, 149

[56] References Cited

U.S. PATENT DOCUMENTS

| | | | |
|---|---|---|---|
| 3,541,799 | 11/1970 | Jost et al. | 405/283 |
| 3,606,757 | 9/1971 | De Weese et al. | 405/283 |
| 3,729,938 | 5/1973 | Morrice | 405/282 |
| 3,782,125 | 1/1974 | Holl | 405/282 |
| 3,788,086 | 1/1974 | West | 405/283 |
| 4,193,717 | 3/1980 | Treacy | 405/283 |
| 4,274,763 | 6/1981 | Krings | 405/282 |

*Primary Examiner*—David H. Corbin

*Attorney, Agent, or Firm*—David A. Jackson; Daniel H. Bobis

[57] ABSTRACT

A method and apparatus for shoring a trench.

The trench shoring apparatus carries a plurality of sheet members movable vertically relative to said apparatus by driving means forming part of the apparatus which carries pre-formed horizontal waling frame carried by and movable relative to the apparatus.

The horizontal waling frame is positionable between the sheet members after the sheet members have been driven by said driving means, so that an upward or downward pressure applied to said waling frame is converted, through the intermediary of said waling frame, into a lateral pressure onto the trench sides, so that the sheet members may be caused to move downwardly or upwardly by increasing the resistance to upward or downward movement of the apparatus. Similarly, a downward pressure applied to means supporting said waling frame, is converted into a lateral pressure, through the intermediary of said waling frame, so as to cause upward movement of said apparatus.

10 Claims, 4 Drawing Figures

METHOD OF AND APPARATUS FOR SHORING A TRENCH

This invention relates to a method of and apparatus for shoring trenches.

In trench work where ground loads have to be supported, it is often necessary to drive vertical sheeting to support the sides of the trench either before or as it is excavated and subsequently to extract this vertical sheeting when pipe laying or other work has been completed. A method and apparatus for inserting and withdrawing such sheeting is described in U.K. Pat. No. 1,561,101.

With apparatus in accordance with the above referred to Pat. No. 1,561,101, it has been found that undesirable pressures can be applied to the sides of the trench at the ground surface during extraction of the sheeting and the raising of the machine in order to move the machine forward. In addition, it has been found that there is an undesirable tendency for the apparatus to lift above the ground in hard ground conditions during insertion of the sheeting.

The present invention seeks to obviate the disadvantages described above by replacing some or all of the downward pressures on the ground surface transmitted through the machine during sheet withdrawal with an outward lateral pressure on the trench sides or with a downward pressure on the sheet members. Such means also prevents the tendency of the apparatus to lift during sheet insertion by replacing some or all of the upward lifting force with a similar outward lateral force on the trench sides, and additionally it provides a means of raising the apparatus relative to the surface level of the ground by replacing some or all of the downward force on the ground surface at the sides of the trench (which would normally be necessary) with an outward lateral force on the trench sides or with a downward pressure on the sheet members.

In conventional trench shoring work there are normally provided, in addition to vertical sheeting, one or more horizontally disposed waling members held apart by a number of cross members, the whole being designed to support earth pressures and other loads on the trench sides. These horizontal waling members are generally supported by vertical tension members so that they are restrained from moving downwardly if the trench should be in an unloaded condition or if there is a possibility of differential movement between the horizontal members.

The present invention provides a trench shoring apparatus incorporating a vertically movable waling frame designed in such a way that it not only supports the ground loads to which the trench sides are subjected in the normal manner but can also withstand vertical loadings in a downwardly or upwardly direction by transforming such vertical loads into an outward lateral force on the trench sides.

According to one aspect of the present invention, there is provided a method of shoring a trench comprising the steps of locating a trench shoring apparatus carrying a plurality of vertically movable sheet members and a pre-formed vertically movable waling frame on ground above a trench to be excavated, moving said plurality of sheet members downwardly into the ground, excavating between said wanted sheet members, and positioning between the inserted sheet members the movable waling frame so as to support said inserted sheet members.

The step of excavating may be carried out prior to the insertion of said sheet members and said waling frame may be positioned in the excavation prior to the insertion of said sheet members. The method will include the further steps of inserting said sheet members further into the ground and excavating between said sheet members and below said waling frame.

Downward movement of the sheet members may be caused by applying an upward pressure to said waling frame, said upward pressure being converted into a lateral pressure onto the trench sides, through the intermediary of the waling frame which is coupled to the apparatus, so as to increase the resistance to upward movement of the apparatus. The resistance to upward movement of the apparatus during the downward movement of the inserted sheet members may be increased by coupling one or more of the inserted sheet members to the apparatus.

The method will include the further step of carrying out post-sheeting work in the excavated trench.

The method will include the still further step of causing upward movement of the sheet members by applying a downward pressure to said waling frame, said downward pressure being converted into a lateral pressure onto the trench sides through the intermediary of said waling frame which is coupled to the apparatus, so as to increase the resistance to downward movement of the apparatus.

The apparatus may be caused to move upwardly relative to said sheet members by applying a downward pressure to means supporting the waling frame, said downward pressure being converted into a lateral pressure, through the intermediary of said waling frame, on said sheet members.

The method will comprise the further step of moving in the direction of the trench means on which the apparatus is located, lowering said apparatus into engagement with said means, moving upwardly said sheet members and said waling frame so that said sheet members and said waling frame are clear of the excavated trench and moving said apparatus on said means in the direction of the trench.

The sheet members may be inserted until the resistance to downward movement of said sheet members is greater than the resistance to upward movement of said apparatus so as to cause upward movement of said apparatus, moving in the direction of the trench means on which the apparatus is located, lowering said apparatus onto said means, moving upwardly said sheet member so that they are clear of the excavated trench, and moving said apparatus on said means in the direction of the trench.

According to a second aspect of the present invention, there is provided apparatus for shoring a trench comprising apparatus carrying a plurality of sheet members which are movable vertically relative to said apparatus, driving means for moving said sheet members relative to said apparatus, a preformed horizontal waling frame carried by and movable relative to said apparatus. Preferably, said sheet members will be of sufficient length and bearing area to enable the apparatus to be raised relative to said sheet members in most ground conditions.

Said horizontal waling frame, which will preferably be movable vertically relative to said sheet members, and which will preferably be releasably coupled to said apparatus, will consist of opposed side members connected together by opposed cross-members which may be variable in length. Said cross-members may include fluid pressure-operated rams to enable said side members to be moved towards and away from each other.

The sheet members will preferably be movable relative to the apparatus by means of vertically movable driving beams, said horizontal waling frame being connected to posts passing through said driving beams so that said waling frame can be driven or extracted as excavation or filling proceeds and fully raised to move forward with the apparatus in the direction of the trench.

Said apparatus will preferably be mounted on wheels, rollers or pads to enable the apparatus to be moved in the direction of the trench, said wheels, rollers or pads being mounted on outriggers of said apparatus.

In order that the invention may be more readily understood, an embodiment thereof will now be described, by way of example, reference being made to the accompanying drawings, wherein.

Figure 1:
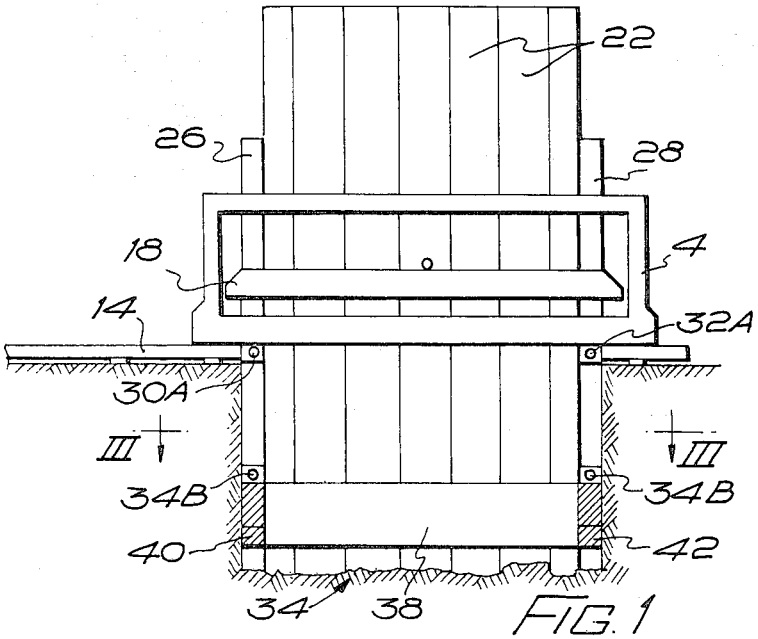
FIG. 1 is a sectional side elevation of trench shoring apparatus according to the invention taken on line I—I in FIG. 2.
Figure 2:
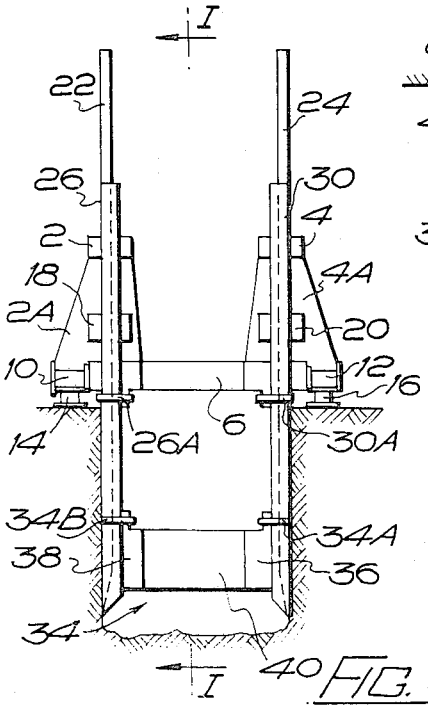
FIG. 2 is an end elevation of the apparatus of FIG. 1.
Figure 3:
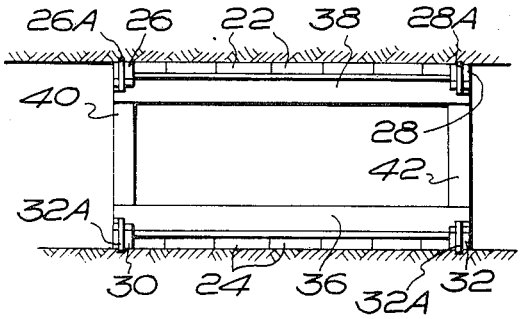
Figure 4:
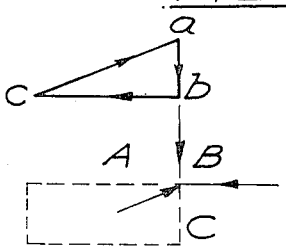

FIG. 3 is a plan view on line III—III of FIG. 1 of the apparatus of FIGS. 1 and 2; and FIG. 4 indicates the direction of the face during sheet extraction acting at a point one side of a waling frame forming a part of the apparatus of the invention, where vertical compression/tension member is coupled to said waling frame, the figure also showing a triangle of forces indicating the relative magnitude of the forces involved;

Referring to the drawings and firstly to FIGS. 1 to 3, the trench shoring apparatus comprises a pair of side frames 2 and 4 which are connected together by cross-members 6. The frames 2 and 4 each carry a series of wheels, pads or rollers 10 and 12 respectively which engage and are adapted to travel along rails 14 and 16 located at the sides of the trench, the wheels, pads or rollers being mounted on outriggers 2A and 4A which are carried by the apparatus.

Mounted within the frames 2 and 4, and movable vertically relative thereto, are driving beams 18 and 20 relative to which are arranged pluralities of sheet members 22 and 24, said sheet members being couplable to their respective driving beam so that the said sheet members may be inserted into and extracted from the ground below the trench shoring apparatus. The sheet members will be of sufficient length and bearing area to enable the apparatus to be raised relative to said sheet members in most ground conditions.

Located at or near each end of each plurality of sheet members and passing through the driving beams 18 and 20, are vertical compression/tension members 26,28,30 and 32, and releasably secured to said compression/tension members is a pre-formed waling frame indicated generally by reference numeral 34. Said waling frame consists of opposed side members 36 and 38, and opposed cross-members 40 and 42. The cross-members 40 and 42 of the waling frame 34 may, if desired, be variable in length and may include fluid pressure-operated rams operable to move the side members 36 and 38 relatively towards and away from each other. The members 26, 28, 30, and 32 are couplable to the apparatus at points indicated by reference numerals 26A, 30A, and 32A (and to a point on the member 28), and to the waling frame at points indicated by reference numerals 34A and 34B.

In operation, and assuming the apparatus to be located with the wheels, pads or rollers 10 and 12 bearing on the rails 14 and 16, the sheet members 22 and 24 are driven downwardly into the ground by coupling the sheet members to the driving beams 18 and 20. The sheet members may be driven alternatively, i.e. one or more of the sheet members 22 will be driven to a predetermined depth, followed by driving one or more of the sheet members 24 which will also be driven to the predetermined depth. The driving beams to which the sheet members are coupled are moved vertically relative to the remainder of the apparatus by fluid pressure-operated driving rams connected between the driving beams and the frames 2 and 4. The sheet members 22 and 24 will be driven in a sequence but where ground conditions permit, the sheet members 22 and 24 may be driven at the same time.

When the sheet members 22 and 24 have been moved relative to the remainder of the apparatus and inserted to a first required depth, as for example in FIGS. 1 and 2, a trench is formed, by an excavator 50, between the inserted lines of sheet members, whereafter the waling frame may be moved downwardly relative to and between the sheet members, so as to support said sheet members, by coupling the members 26 and 32 to the driving beams 18 and 20 and simultaneously downwardly said driving beams.

It will be appreciated that the excavation may be carried out prior to the insertion of said sheet members, and that the waling frame may be lowered into this excavation prior to the insertion of said sheet members. The sheet members are then driven further into the ground and the apparatus is prevented from moving upwardly by connecting some of said sheet members to the apparatus and driving the remaining sheet members.

The remainder of the trench is then excavated between the inserted sheet members, whereafter post-sheeting is carried out in the trench and the trench refilled to a lateral vertical plate (not shown) which thus ensures that, for example, the leading end of a leading pipe section remains exposed so as to facilitate subsequent connection of pipe sections.

When that section of the trench has been refilled, and to enable the apparatus to be moved forwardly in the direction of the trench, the driving rams are pressurised so as to force the sheet members 22 and 24 against the bottom of the trench, and because the resistance of the unexcavated ground at the bottom of the trench will be greater than the weight of the apparatus, the apparatus will rise relative to the sheet members, such that the wheels, pads or rollers 10 and 12 will rise clear of the rails 14 and 16. This enables the rails 14 and 16 to be moved forwardly. The apparatus may then be lowered, by releasing the pressure from the driving rams, so that the pads or rollers 10 and 12 again contact the rails, whereafter the sheet members 22 and 24 are moved vertically upwards so that they are clear of the ground. The apparatus is then moved forward on the rails to the next section of trench to be excavated, the apparatus preferably being moved by the excavator 50.

Where the resistance of the bottom of the trench to downward movement of the sheet members is not great enough to cause the apparatus to lift clear of the rails 14 and 16, the members 26 and 32 are connected to the driving beams 18 and 20, and by application of vertical pressure alternately to said driving beams the apparatus is caused to move upwardly relative to the sheet members. The vertical pressure applied to the members 26 and 32 alternately is transmitted to the waling frame which is unable to move downwardly under pressure from one side alone. The vertical pressure is therefore converted to an outward lateral pressure onto the sheet members 22 and 24 and thus to the trench sides. Thus, the apparatus is caused to lift clear of the rails 14 and 16.

The same principles can be applied to give added resistance for driving the sheet members and to enable the sheet members to be extracted without undesirable loads on the ground surface. In these cases, the members 26 to 32 are coupled to the apparatus at points 26A to 32A and pressure is applied alternately to the driving beams 18 and 20 to which are coupled one or more of the sheet members 22 and 24. The vertical pressure on the members 26 to 32 is converted via the waling frame 34 into outward lateral pressure on the trench sides.

FIG. 4 illustrates the forces which are present during the withdrawal of the sheet members 22 and 24, the force A/B representing the downward force applied to the driving beams during withdrawal, the force B/C representing the reaction forces at the sides of the trench, and the force C/A representing the compressive force in the waling frame 34.

I claim:

1. A method of shoring a trench comprising the steps of:

locating a trench shoring apparatus carrying a plurality of vertically movable sheet members and a preformed vertically movable waling frame on ground above a trench to be excavated, moving said plurality of sheet members downwardly into the ground, excavating between said sheet members, positioning between the inserted sheet members the movable waling frame so as to support said inserted sheet members, one of moving the inserted sheet members further into the ground and excavating below the waling frame, the other of moving the inserted sheet members further into the ground and excavating below the waling frame, causing said downward movement of the sheet members by applying an upward pressure to said waling frame, said upward pressure being converted into a lateral pressure onto the trench sides, through the intermediary of the waling frame which is coupled to the apparatus, so as to increase the resistance to upward movement of the apparatus, increasing the resistance to upward movement of the apparatus during the downward movement of the inserted sheet members by coupling one or more of the inserted sheet members to the apparatus, carrying out post-sheeting work in the excavated trench, and causing upward movement of the sheet members by applying a downward pressure to said waling frame, said downward pressure being converted into a lateral pressure onto the trench sides through the intermediary of said waling frame which is coupled to the apparatus, so as to increase the resistance to downward movement of the apparatus.

2. A method of shoring a trench comprising the steps of:

locating a trench shoring apparatus carrying a plurality of vertically movable sheet members and a preformed vertically movable waling frame on ground above a trench to be excavated, excavating below said apparatus, moving said plurality of sheet members downwardly into the ground, positioning said waling frame between said inserted sheet members so as to support said inserted sheet members, one of moving the inserted sheet members further into the ground and excavating below the waling frame, the other of moving the inserted sheet members further into the ground and excavating below the waling frame, causing said downward movement of the sheet members by applying an upward pressure to said waling frame, said upward pressure being converted into a lateral pressure onto the trench sides, through the intermediary of the waling frame which is coupled to the apparatus, so as to increase the resistance to upward movement of the apparatus, increasing the resistance to upward movement of the apparatus during the downward movement of the inserted.sheet members by coupling one or more of the inserted sheet members to the apparatus, carrying out post-sheeting work in the excavated trench, and causing upward movement of the sheet members by applying a downward pressure to said waling frame, said downward pressure being converted into a lateral pressure onto the trench sides through the intermediary of said waling frame which is coupled to the apparatus, so as to increase the resistance to downward movement of the apparatus.

3. A method of shoring a trench comprising the steps of:

locating a trench shoring apparatus carrying a plurality of vertically movable sheet members and a preformed vertically movable waling frame on ground above a trench to be excavated, excavating below said apparatus, positioning said waling frame in said excavation, moving the plurality of sheet members downwardly outside said waling frame so as to support said sheet members by said waling frame, one of moving the inserted sheet members further into the ground and excavating below the waling frame, the other of moving the inserted sheet members further into the ground and excavating below the waling frame, causing said downward movement of the sheet members by applying an upward pressure to said waling frame, said upward pressure being converted into a lateral pressure onto the trench sides, through the intermediary of the waling frame which is coupled to the apparatus, so as to increase the resistance to upward movement of the apparatus, increasing the resistance to upward movement of the apparatus during the downward movement of the inserted sheet members by coupling one or more of the inserted sheet members to the apparatus, carrying out post-sheeting work in the excavated trench, and causing upward movement of the sheet members by applying a downward pressure to said waling frame, said downward pressure being converted into a lateral pressure onto the trench sides through the intermediary of said waling frame which is coupled to the apparatus, so as to increase the resistance to downward movement of the apparatus.

4. A method according to any of claims 1 to 3, comprising the further steps of causing upward movement of the apparatus relative to said sheet members by applying a downward pressure to means supporting the waling frame, said downward pressure being converted into a lateral pressure, through the intermediary of said waling frame, on said sheet members.

5. A method according to claim 4 comprising the further step of moving in the direction of the trench means on which the apparatus is located, lowering said apparatus into engagement with said means, moving upwardly said sheet members and said waling frame so that said sheet members and said waling frame are clear of the excavated trench and moving said apparatus on said means in the direction of the trench.

6. A method according to any of claims 1 to 3, comprising the further step of inserting said sheet members until the resistance to downward movement of said sheet members is greater than the resistance to upward movement of said apparatus so as to cause upward movement of said apparatus, moving in the direction of the trench means on which the apparatus is located, lowering said apparatus onto said means, moving upwardly said sheet members so that they are clear of the excavated trench, and moving said apparatus on said means in the direction of the trench.

7. Apparatus for shoring a trench comprising:

apparatus carrying a plurality of sheet members which are of sufficient length and bearing area to enable the apparatus to be raised relative to said sheet members in most ground conditions and which are movable vertically relative to said apparatus, driving means for moving said sheet members relative to said apparatus, said driving means including vertically movable driving beams, and a pre-formed horizontal waling frame releasably coupled to and movable vertically relative to said apparatus, said waling frame including opposed side members and opposed cross-members for connecting together said side members, said cross-members being variable in length, said horizontal waling frame being connected to posts passing through said driving beams so that the waling frame can be moved vertically as escavation and filling proceed and fully raised relative to the sheet members and clear of the trench to move forward with the apparatus in the direction of the trench.

8. Apparatus according to claim 7, wherein said cross-members include fluid pressure-operated rams to enable said side members to be moved towards and away from each other.

9. Apparatus according to either of claims 7, wherein said apparatus is mounted on means to enable the apparatus to be moved in the direction of the trench.

10. Apparatus according to claim 9, wherein said means are mounted on outriggers of said apparatus.

* * * * *